US009982422B2

(12) United States Patent
Courtney et al.

(10) Patent No.: US 9,982,422 B2
(45) Date of Patent: May 29, 2018

(54) FIXTURE FOR A SINK

(71) Applicant: Dyson Technology Limited, Wiltshire (GB)

(72) Inventors: Stephen Benjamin Courtney, Bath (GB); Patrick Joseph William Moloney, Swindon (GB); Christopher Lesniowski, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 144 days.

(21) Appl. No.: 14/995,022

(22) Filed: Jan. 13, 2016

(65) Prior Publication Data

US 2016/0130792 A1 May 12, 2016

Related U.S. Application Data

(63) Continuation of application No. 13/474,315, filed on May 17, 2012.

(30) Foreign Application Priority Data

May 17, 2011 (GB) ..... 1108240.1

(51) Int. Cl.
*E03C 1/18* (2006.01)
*E03C 1/05* (2006.01)
(Continued)

(52) U.S. Cl.
CPC ..... *E03C 1/057* (2013.01); *A47K 10/48* (2013.01); *E03C 1/01* (2013.01); *E03C 1/0404* (2013.01);
(Continued)

(58) Field of Classification Search
CPC ..... A47K 10/38; A47K 10/48; A47K 2210/00
(Continued)

(56) References Cited

U.S. PATENT DOCUMENTS 4,145,769 A 3/1979 MacFarlane et al.
4,336,619 A * 6/1982 Hinkel ..... A47K 10/48 312/228
(Continued)

FOREIGN PATENT DOCUMENTS

CN 101232837 7/2008
DE 504 089 7/1930
(Continued)

OTHER PUBLICATIONS

Search Report dated Sep. 16, 2011, directed to GB Application No. 1108240.1; 2 pages.
(Continued)

*Primary Examiner* — Erin Deery
*Assistant Examiner* — Nicholas Ros
(74) *Attorney, Agent, or Firm* — Morrison & Foerster LLP

(57) ABSTRACT

A dual-purpose fixture for a sink or wash basin, incorporating both a water tap and a hand dryer. The water tap has a spout arranged to project over the basin of the sink, and the hand dryer incorporates two or more hand-dryer nozzles—at least one for each of a user's hands. The left-hand nozzle is located on the left-hand side of the spout and the right-hand nozzle is located on the right-hand side of the spout, specifically so that the spout acts as a dividing partition between the two hand-dryer nozzles. This encourages correct usage of the hand-dryer. The fixture may be fitted to a sink or wall-mounted above the sink.

15 Claims, 8 Drawing Sheets

(51) Int. Cl.
*A47K 10/48* (2006.01)
*E03C 1/01* (2006.01)
*E03C 1/04* (2006.01)

(52) U.S. Cl.
CPC .... *Y10T 137/8593* (2015.04); *Y10T 137/9464* (2015.04)

(58) Field of Classification Search
USPC ..... 4/638, 535, 643, 648, 675, 678; 34/90
See application file for complete search history.

(56) References Cited

U.S. PATENT DOCUMENTS

| | | | | |
|---|---|---|---|---|
| 4,398,310 | A * | 8/1983 | Lienhard | A47K 10/48 4/623 |
| 5,074,322 | A * | 12/1991 | Jaw | A47K 10/48 134/102.3 |
| 5,199,118 | A | 4/1993 | Cole et al. | |
| 6,185,838 | B1 | 2/2001 | Moore | |
| 7,774,953 | B1 * | 8/2010 | Duran | A47K 10/48 239/54 |
| 8,347,522 | B2 | 1/2013 | Dyson et al. | |
| 2008/0222910 | A1 * | 9/2008 | Churchill | A47K 10/48 34/202 |
| 2008/0301970 | A1 | 12/2008 | Hackwell et al. | |
| 2009/0113748 | A1 | 5/2009 | Dyson et al. | |
| 2012/0291303 | A1 | 11/2012 | Courtney et al. | |
| 2013/0340272 | A1 | 12/2013 | Courtney et al. | |
| 2014/0130250 | A1 | 5/2014 | Courtney et al. | |

FOREIGN PATENT DOCUMENTS

| | | | | |
|---|---|---|---|---|
| DE | 2 018 695 | | 10/1971 | |
| EP | 1 915 935 | | 4/2008 | |
| EP | 2 177 142 | | 4/2010 | |
| EP | 2 399 497 | | 12/2011 | |
| GB | 2 249 026 | | 4/1992 | |
| GB | 2 428 569 | | 2/2007 | |
| JP | 1-71575 | | 5/1989 | |
| JP | 2-76636 | | 6/1990 | |
| JP | 8-266939 | | 10/1996 | |
| JP | 10-248748 | | 9/1998 | |
| JP | 11-244190 | | 9/1999 | |
| JP | 2000-271039 | | 10/2000 | |
| JP | 2001-3407 | | 1/2001 | |
| JP | 2001-140305 | | 5/2001 | |
| JP | 2001140305 | * | 5/2001 | A47K 10/48 |
| JP | 2002-136448 | | 5/2002 | |
| JP | 2004-261510 | | 9/2004 | |
| JP | 2006-192250 | | 7/2006 | |
| JP | 2006-304926 | | 11/2006 | |
| JP | 2008-99797 | | 5/2008 | |
| JP | 2008-272086 | | 11/2008 | |
| JP | 2009-502390 | | 1/2009 | |
| JP | 3160341 | * | 6/2010 | A47K 10/48 |
| KR | 10-2009-0030788 | | 3/2009 | |
| WO | WO-96/26795 | | 9/1996 | |
| WO | WO-2007/015045 | | 2/2007 | |
| WO | WO-2009/039290 | | 3/2009 | |
| WO | WO-2009/062546 | | 5/2009 | |
| WO | WO-2010/088975 | | 8/2010 | |
| WO | WO-2011/044247 | | 4/2011 | |
| WO | WO-2011/074018 | | 6/2011 | |

OTHER PUBLICATIONS

International Search Report and Written Opinion dated Aug. 10, 2012, directed to International Application No. PCT/GB2012/051098; 11 pages.

Courtney et al., U.S. Office Action dated Aug. 14, 2014, directed to U.S. Appl. No. 13/474,315; 10 pages.

Courtney et al., U.S. Office Action dated Mar. 5, 2015, directed to U.S. Appl. No. 13/474,315; 11 pages.

Courtney et al., U.S. Office Action dated Jun. 25, 2015, directed to U.S. Appl. No. 13/474,315; 11 pages.

Courtney et al., U.S. Office Action dated Nov. 19, 2015, directed to U.S. Appl. No. 14/118,117; 11 pages.

* cited by examiner

PRIOR ART

FIXTURE FOR A SINK

REFERENCE TO RELATED APPLICATIONS

This application is a continuation of U.S. patent application Ser. No. 13/474,315 filed May 17, 2012, which claims the priority of United Kingdom Application No. 1108240.1, filed May 17, 2011, the entire contents of which are incorporated herein by reference.

FIELD OF THE INVENTION

The present invention relates generally to the field of hand drying, and in particular to arrangements for hand-drying at a sink such as may be provided in a commercial washroom or the like.

BACKGROUND OF THE INVENTION

In washrooms, it is common to provide one or more sinks or water basins for washing, and one or more separate, wall-mounted hand-dryers which users can then use to dry their hands.

FIG. 1 illustrates one type of wall-mounted hand-dryer 1, which is currently marketed and sold under the model name AB01, as part of the Dyson Airblade® range of hand dryers. It works by using a motor-driven fan to force air at high pressure through an opposing pair of narrow, slit-like nozzles 2, 3, each less than 1 mm wide. This creates two opposing thin sheets, or "blades", of high velocity air which act to strip water from the front and backs of a user's hands as they are 'dipped'—palms open—between the opposing nozzles 2, 3.

The drying air is fed to the nozzle 3 via a respective air duct 3*a* which connects to the pressure side of a motor-driven fan (not shown) located inside the hand dryer 1. The air duct 3*a* flattens near the nozzle so that it spans the width of the nozzle 3. Consequently, air is fed from behind the nozzles 3, with different portions of the nozzle 3 effectively being fed in parallel, and the air exits the nozzle 3 "straight-on". This is illustrated in FIG. 1.

Air is fed to the rear nozzle 2 in a similar manner via a separate duct (not shown) corresponding to the duct 3*a*. The nozzle 2 is scalloped to follow the back of the user's hands: this deliberate physical shaping of the rear nozzle encourages "turning" of the airflow as it passes through the nozzle 2, so that air is angled both into the thumb and forefinger of the user and also back into the little finger of the user, which improves the overall drying performance. This is also illustrated in FIG. 1.

In some washrooms, hand dryers are instead located over the basin of the sink, so that a user can conveniently dry their hands at the sink—without having to move—and at the same time water dripping from the hands can collect in the basin of the sink and drain into the mains drainage system through the existing waste pipe. One such arrangement is described in U.S. Pat. No. 5,199,118A.

The present invention is concerned with hand drying at a sink or water basin.

SUMMARY OF THE INVENTION

According to the present invention there is provided a fixture for a sink, the fixture comprising: a water tap incorporating a spout arranged to project over the basin of the sink, and two hand-dryer nozzles—at least one for each of a user's hands; wherein each left-hand nozzle is located on the left-hand side of the spout and each right-hand nozzle is located on the right-hand side of the spout so that the spout acts as a dividing partition between the left-hand and right-hand nozzles.

The fixture is thus dual-purpose: it incorporates both a water tap for washing a user's hands and at least one hand-dryer nozzle for drying each of the user's hands. Advantageously, the configuration of the fixture means also that the water spout itself is dual-function: it both conveys water for washing and then usefully functions as a partition between the hand-dryer nozzles to encourage correct usage of the left-hand nozzle for drying the left hand and the right-hand nozzle simultaneously for drying the right hand.

In this context, the "left-hand side"/"right-hand side" is the side which, in use, is on the user's left/right when the user is standing in front of the sink, facing the fixture. Similarly, the "left hand nozzle"/"right hand nozzle" is the nozzle nominally intended to be used to dry a user's left/right hand.

The fixture is preferably arranged so that the spout bisects the two nozzles—thus acting as a central partition between the nozzles—but this is not essential.

In a particular embodiment, there is provided a fixture comprising i) an opposing pair of said left-hand nozzles arranged on the left side of the spout for directing air onto the front and back of a user's left hand as it is passed—with open palm—in between the opposing nozzles, and ii) an opposing pair of said right-hand nozzles arranged on the right hand side of the spout for directing air onto the front and back of a user's right hand as it is passed—with open palm—in between the nozzles.

Thus, the nozzles provide an advantageous, "double-sided" hand-drying action. Positioning the opposing nozzles on the fixture—rather than, for example, the opposing walls of the sink—allows the separation between opposing nozzles to be optimized. This is particularly beneficial for high-speed hand dryers (exit airspeed >100 m/s), because subsequent diffusion of the airflow after it exits the nozzles can cause the airspeed to fall off dramatically over distances of the order of a few cm, so the ability to optimize the separation between opposing nozzles is critical to achieving good drying performance.

The left-hand and right-hand nozzles may conveniently be positioned along respective parts of the fixture which extend laterally away from the spout. Equally, said opposing pair of left-hand and right-hand nozzles may conveniently be positioned along respective opposing parts of the fixture which each extend laterally away from the spout. Positioning the nozzles on a laterally-extending part of the fixture—rather than directly on the wall of the spout—allows the nozzles to be located at a more natural width for the user. The laterally-extending parts of the fixture need not extend perpendicular to the spout.

A plurality of left-hand nozzles (or plurality of opposing pairs of left-hand nozzles) may be provided, extending along the respective part (or opposing parts) of the fixture. Similarly, a plurality of right-hand nozzles (or plurality of opposing pairs of right-hand nozzles) may be provided, extending along the respective part (or opposing parts) of the fixture. The nozzles may be arranged in one or more rows on the respective part of the fixture.

Utilizing a plurality of nozzles extending laterally along the respective part of the fixture, the effective width of the drying jet is increased. A similar effect can be achieved using fewer nozzles—possibly one nozzle—if the nozzle(s) is (are) elongated.

The laterally extending parts of the fixture may each comprise a supply duct, with the respective nozzle(s) on that part of the fixture extending axially along the wall of the supply duct so as to extend across the width of the user's hand when it is held—palm open—in front of the nozzles. Each supply duct is arranged to communicate at its inlet end—being the end nearer the user's respective thumb in use—with the output side of a motor-driven fan for driving an axial airflow through the duct, serially to each of the nozzles.

Thus, air is fed "inside-to-out" axially along the supply duct. Consequently, the nozzle exit velocity towards the inlet end of the supply duct has a significant axial component, which tends to angle the airflow into the thumb and forefinger of the user in use, for effective drying of that area of the user's hand. This is achieved without the inconvenience and cost of having to use "shaped" nozzles such as the rear 'scalloped' nozzle in FIG. 1.

A large axial component to the nozzle exit velocity may be less preferable away from the user's thumb, where straighter nozzle exit velocities may instead be preferred for providing "square-on" drying of the user's hands. This is addressed by controlling the axial velocity of the airflow along the supply duct so that it decreases along the length of the supply duct, thus progressively "straightening" the nozzle exit velocities.

The axial velocity is controlled using a suitable cross-sectional profile for the supply duct. In one embodiment, the supply duct is arranged to have a generally constant cross-sectional area (preferably cylindrical for ease of manufacture, though this is not essential). In this case, the axial airflow velocity through the supply duct gradually decreases along the duct due to serial airflow losses through the nozzle(s).

The use of a constant cross-sectional area along the supply duct is not essential, however, in order to achieve the aforementioned straightening effect. Alternatively, the cross-sectional area may vary, provided it does so in a manner which nevertheless ensures such straightening of the nozzle exit velocity via a corresponding progressive reduction in the axial flow velocity through the supply duct.

For example, the duct may taper along the length of the supply duct. In this sort of arrangement, serial flow losses through the nozzle(s) will again tend to reduce the axial flow velocity through the supply duct. If the taper is a reverse taper, so that the cross sectional area increases with distance from the inlet end of the duct, then the taper will contribute a further reduction in axial flow velocity along the supply duct, consistent with the Continuity Principle.

By contrast, a forward taper will in accordance with the same Principle tend to increase the axial velocity through the supply duct. In this case, a progressive reduction in the axial nozzle velocity can nevertheless be achieved simply by ensuring that the aforementioned effect of the taper does not entirely off-set the reduction in flow velocity due to serial flow losses through the upstream nozzles (or upstream portions of the nozzle in the case of an elongate slit). Other cross-sectional profiles may likewise be employed whilst nevertheless ensuring a net reduction in axial velocity along the supply duct.

The nozzle(s) preferably extends across the full width of the user's hand, for effective drying across the full hand span of the user.

In one embodiment, the nozzles each span a width in the range of 80 mm to 170 mm, for example.

Though not essential, a preferred range of widths for the nozzle(s) is 130-170 mm (to be measured across all of the nozzles collectively in the case of a plurality of nozzles). This tends to ensure that the nozzle(s) will effectively extend across the majority of user's hands in use. The precise nozzle width will be a trade-off between, on the one hand, a compact fixture design and, on the other hand, the usability of the fixture for users with relatively large hands. Accordingly, the preferred width may vary—for example by country or according to the specific sink design. However, tests show that a width specification of 150 mm for the nozzle(s) (with a tolerance of ±10 mm) generally offers a good compromise in most cases.

In a particular embodiment, the nozzles are fed by an air duct running through the spout. Utilizing the spout for running the air duct to the nozzles provides for a compact fixture design. In this case, the aforementioned supply ducts would communicate with the motor-driven fan via the air duct running through the spout, and in a particularly simple configuration the supply ducts may effectively be in the form of laterally-extending branches of the air duct running through the spout—so that the supply ducts and main air duct together form a unitary part.

The wall of the supply ducts may—and preferably do—form part of the exterior of the fixture. This tends to reduce the part count and assembly costs.

The laterally-extending parts of the fixture and the spout may all lie in a substantially common plane. This helps minimize interference of the fixture with the washing of a user's hands.

The nozzle(s) may be in the form of an elongate slit, less than 1 mm in width, extending along the respective part of the fixture.

According to another aspect of the present invention, there is provided an arrangement comprising: a sink in combination with a fixture as described above, the fixture being fitted to the sink with the spout projecting over the basin of the sink, the hand dryer nozzles on the fixture being fluidly connected to the pressure side of a motor-driven fan for forcing airflow through the nozzles to dry a user's hands. The motor-driven fan may be configured to force airflow through the nozzles at an exit speed which exceeds 100 m/s, preferably between 150 m/s and 250 m/s.

The spout itself may be arranged to project downwardly over the basin of a sink at an angle between 0 and 15 degrees, making it particularly comfortable to 'dip' the hands—palms open—between the opposing nozzles, particularly if the laterally-extending parts of the fixture lie in the same plane as the spout.

BRIEF DESCRIPTION OF THE DRAWINGS

Embodiments of the invention will now be described by way of example with reference to the accompanying drawings, in which:

FIGS. 2-5 show various views of an arrangement comprising a conventional sink 1 and a fixture 2.

DETAILED DESCRIPTION OF THE INVENTION

Figure 1:
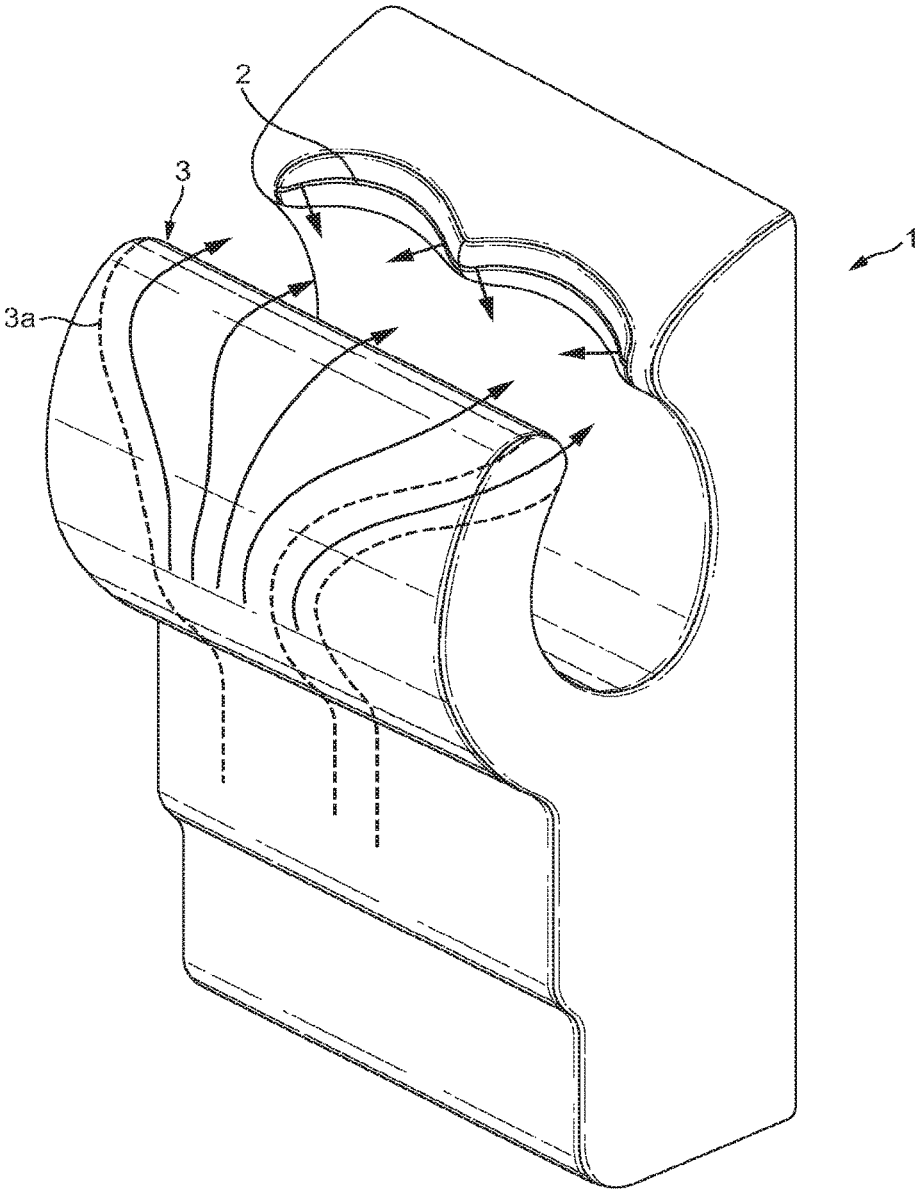
FIG. 1 is a perspective view of a conventional hand dryer.

The sink 1 happens to be a "Belfast-style" sink, but in general the sink may be of any conventional type.

The fixture 2 is fitted to the sink 1 using a locknut 4 underneath the sink 1 which engages with an externally threaded, hollow fixing stud 6 to clamp the fixture 2 in place (the fixture 2 may alternatively be fitted adjacent the sink rather than to the sink itself, according to the style of sink).

The fixture 2 comprises a water tap having a main body 8 which sits adjacent the basin of the sink 1 and a spout 10 which projects from the main body 8 out over the basin of the sink 1.

On demand, water for washing is supplied from a main supply line via a water supply pipe 12, which runs inside the main body 8 and the spout 10 to a downwardly-facing outlet 10*a* provided at the fore-end of the spout 10.

The water tap is configured for "hands-free" operation using a conventional sensor and control loop, which automatically opens a stop valve in the supply line in response to detection of a user's hands in a washing position. Alternatively, the water tap may be configured for manual operation.

The fixture 2 also incorporates a hand dryer, which utilizes the inside of the main body 8 and spout 10 as an air duct 11, feeding a plurality of hand-dryer nozzles provided on the fixture 2.

Figure 6:
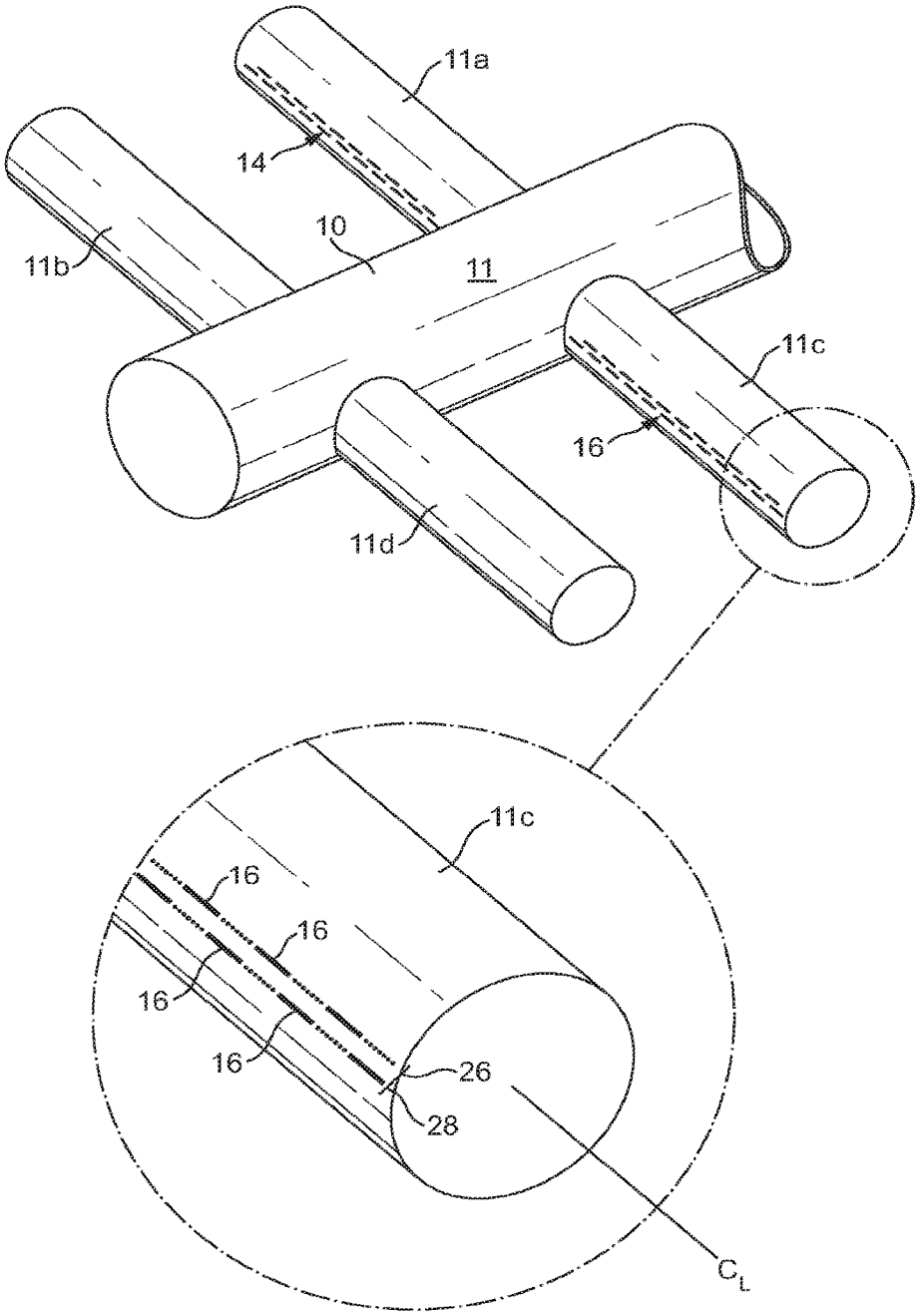
FIG. 6 is a perspective view—partly enlarged—of part of the fixture shown in FIGS. 2 to 5.

The hand-dryer nozzles are arranged in two groups: a plurality of left-hand drying nozzles 14, which are intended in use for drying the user's left hand, and a plurality of right hand nozzles 16, which are intended in use for drying a user's right hand. The nozzles 14, 16 have been omitted from FIG. 2 for clarity purposes, but are shown in FIG. 6.

The left-hand nozzles 14 are provided on the left-hand side of the spout 10. The right-hand nozzles 16 are provided on the right-hand side of the spout 10.

The left-hand nozzles 14 are arranged in opposing pairs along respective laterally-extending (in this case perpendicularly-extending) supply ducts 11*a*, 11*b*, which essentially form integral branches of the air duct 11. Similarly, the right-hand nozzles 16 are arranged in opposing pairs which are positioned along respective laterally-extending (in this case perpendicularly-extending) supply ducts 11*c*, 11*d*, which likewise form branches of the air duct 11.

The nozzles 14, 16 are arranged in two rows along each respective supply duct 11*a-d*.

FIG. 6 shows the specific pattern of nozzles 16 on the respective supply duct 11*c*, with the nozzles in one row 26 being laterally offset relative to the nozzles in the adjacent row 28. The nozzles 16 on the opposing branch 11*b* of the air duct 11 are laterally offset in the opposite sense, indicated by the dotted lines in FIG. 6, so that the pairs of opposing nozzles are not positioned directly opposite one another. This helps to reduce noise in use by preventing collision between the opposing air jets exiting the nozzles 16. The left-hand nozzles 14 are arranged in similar fashion on the respective branches 11*a*, 11*b* of the airduct 11.

The air duct 11 is connected to the positive pressure (output) side of a motor-driven fan unit 30 via a flexible hose 32 which fluidly connects to the inside of the main body 8 via the hollow fixing stud 6 (if the water supply pipe 12 runs through the fixing stud 6—effectively within the air supply line—then adequate provision will need to be made to route the pipe 12 to the exterior of the air supply line, for connection to the water supply line). On demand, air is forced by the fan 30 through the air duct 11 and out through each of the nozzles 14, 16.

The hand dryer is configured for "hands-free" operation using a conventional sensor and control loop, which automatically switches on the fan unit 30 in response to detection of a user's hands in a drying position (which should be distinguishable from the aforementioned washing position—which automatically activates the water tap). Alternatively, the hand dryer may be configured for manual operation.

In use, a user can perform both washing and hand-drying operations at the sink 1.

To commence the washing operation, the user places his (or her) hands underneath the outlet 10*a* as if to wash his hands, and the sensor and control loop operates to deliver water through the outlet 10*a*. The user can then proceed to wash his hands in conventional manner over the basin of the sink 1.

Figure 7:
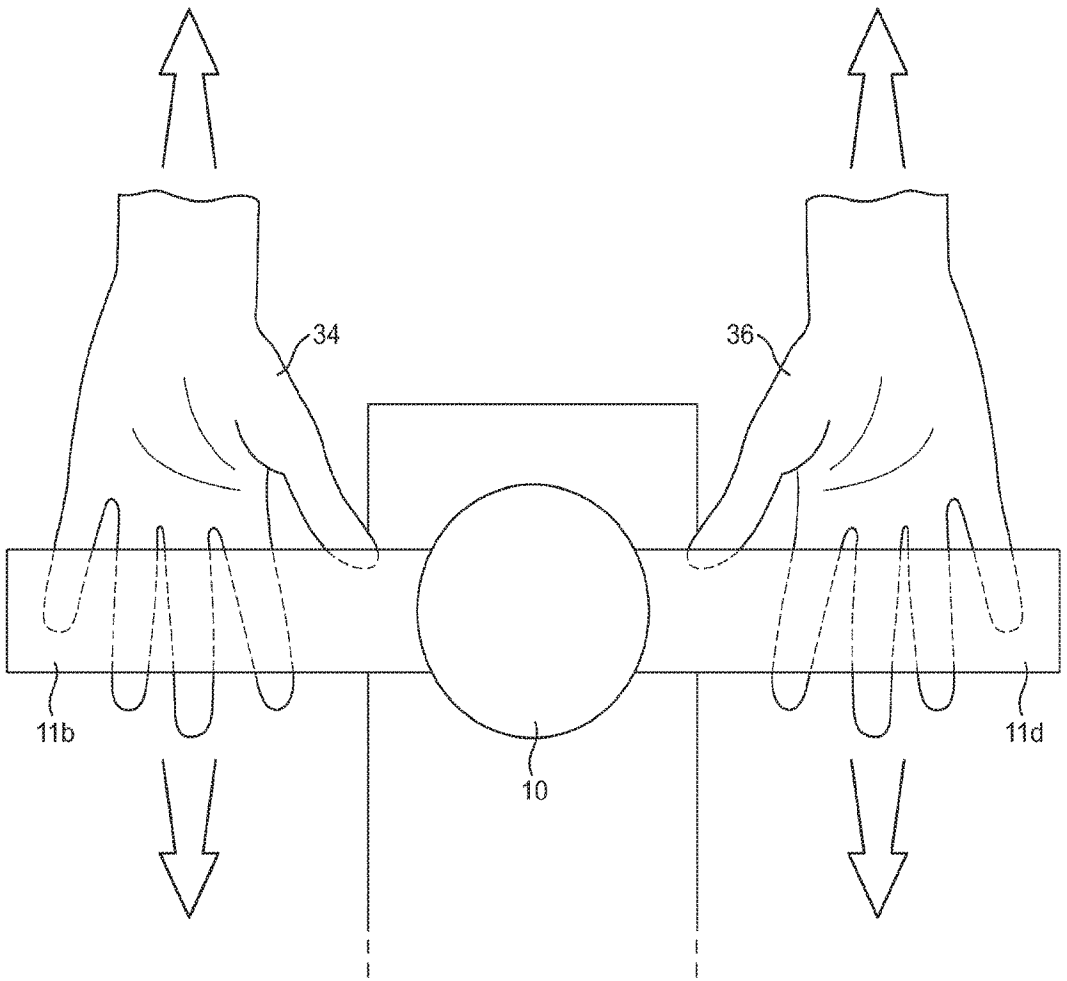
FIG. 7 is a view from the front of the fixture illustrated in FIGS. 2 to 6, illustrating the fixture in use.

To commence the hand-drying operation, a user dips his wet left-hand—palm open—between the opposing pairs of nozzles 14 on the left-hand side of the spout 10 and, at the same time, dips his wet right-hand—palm open—between the opposing pairs of nozzles 16 on the right hand of the spout 10. The sensor and control loop then operates to activate the fan 30, which forces air under high pressure through the opposing nozzles 14, 16: directing high-momentum airflow onto the front and backs of the user's hands, respectively. To dry his hands, the user then makes one or more generally 'vertical' passes between the slots—palms held open—and the high momentum airflow strips water from the surface of the user's hands. The general dipping action of the left hand 34 and right hand 36 is illustrated in FIG. 7 (here, looking axially along the spout 10 from the front), which also illustrates how the spout 10 functions as a central dividing partition between the hands 34, 36, encouraging correct usage.

Figure 4:
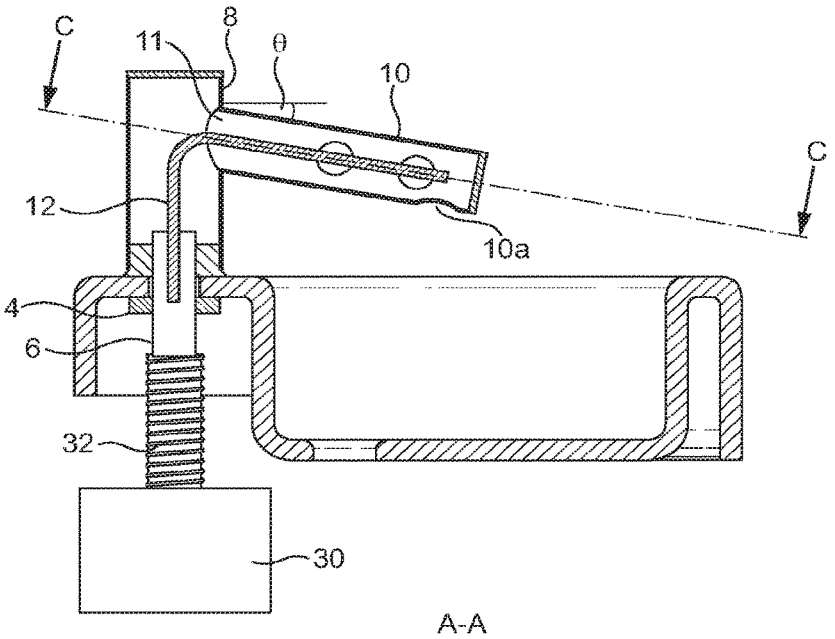
FIG. 4 is a section taken along A-A in FIG. 3.
Figure 5:
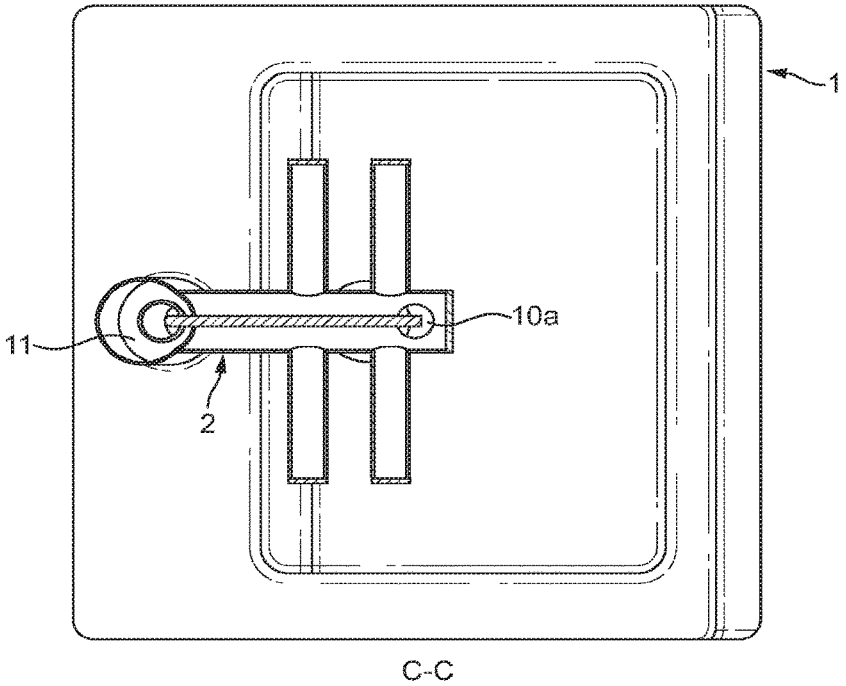
FIG. 5 is a section taken along C-C in FIG. 4.

The lateral branch ducts 11*a-d* lie in generally the same plane as the spout 10, which extends downwardly towards the user at an angle θ (FIG. 4) in the range 5 to 15 degrees, preferably 10 degrees. Thus, rather than the user having to dip his hands vertically between opposing nozzles, the hand entry-angle is tilted towards the user to make the dipping action more comfortable.

The waste water driven from the hands is conveniently collected in the basin of the sink 1, where it may drain to the mains through the conventional plumbing system for the sink 1.

Figure 8:
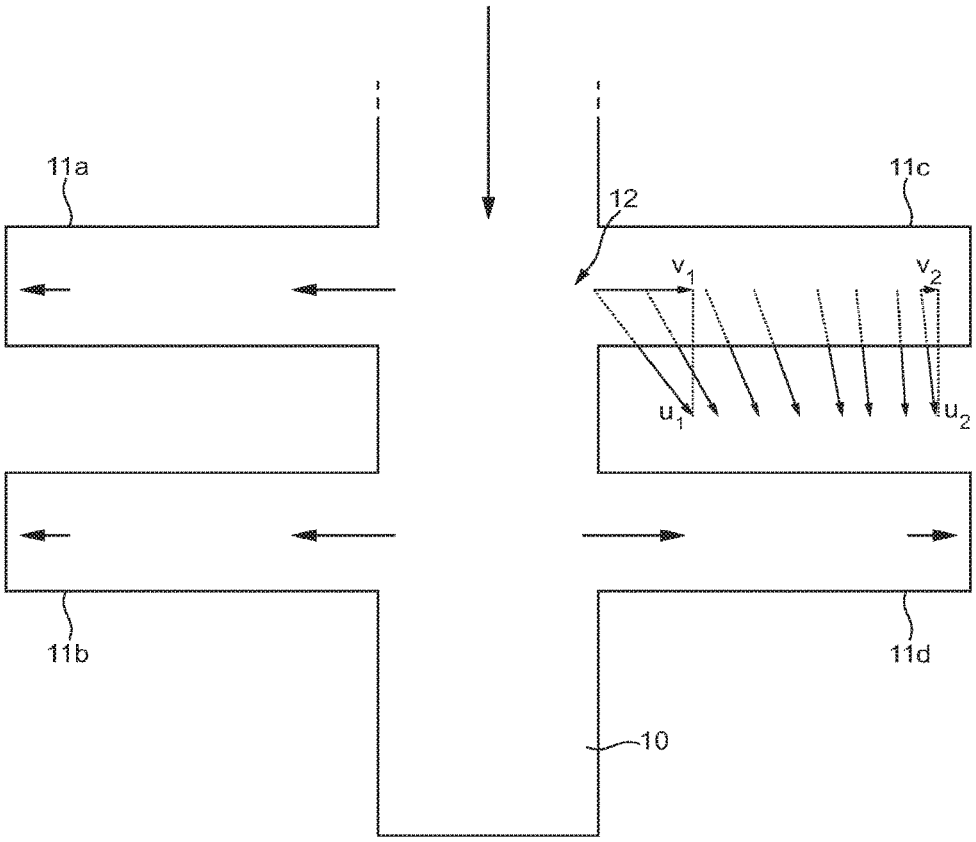
FIG. 8 is a plan view corresponding to FIG. 6, but additionally illustrating the nozzle exit velocity profile for one of the supply ducts forming part of the fixture.

FIG. 8—here, looking down on the fixture 2 from above—shows the nozzle exit velocity profile along the supply duct 11*c* (which is also illustrative of the exit velocity profile for the remaining supply ducts 11*a*, 11*b*, 11*d*).

The exit velocity profile is characterized by a significant axial component to the nozzle exit velocity U1 nearer the inlet end 12 of the supply duct 11*c*, due to the high axial duct velocity V1. This helps to angle the airflow into the thumb and forefinger for effective drying of this area of the hand.

Away from the inlet end of the branch ducts 11*c*, there is a progressive decrease in the axial duct velocity due to a combination of serial flow losses through upstream nozzles and the uniform cross-sectional area of the duct 11*c*. Consequently, there is a progressive straightening of the nozzle exit velocity along the length of the branch ducts (the intermediate nozzle exit velocities are illustrated only schematically in FIG. 8). So for example, near the very end of the branch ducts 11*c*, the axial duct velocity V2 is relatively small and the exit velocity U2 is relatively straight.

The progressive straightening of exit velocities along the length of the branch ducts 11*a-d* helps maintain a more neutral "square-on" drying characteristic away from the thumb and forefinger.

Figure 9:
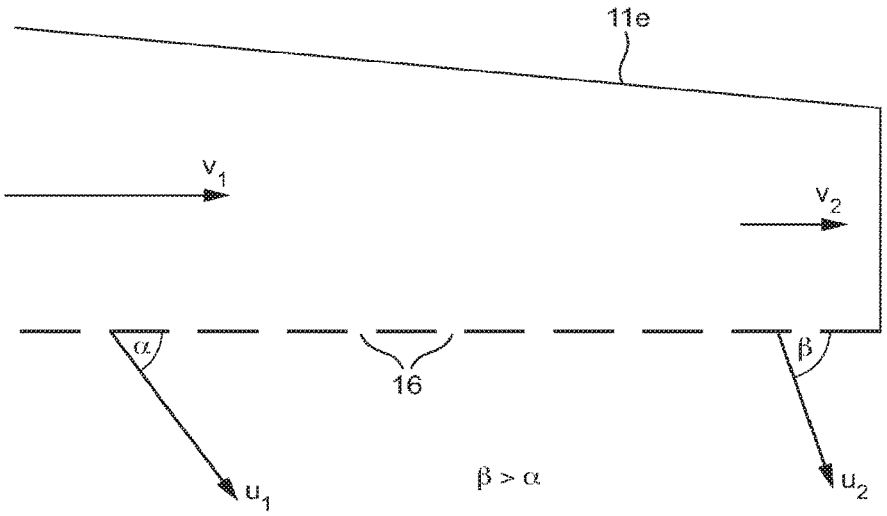
FIG. 9 is a schematic view of an alternative, tapering supply duct.

The use of a supply duct having a uniform cross-sectional area is not essential to provide the straightening effect shown in FIG. 8, though use of a cylindrical supply duct may be preferable for ease of manufacture. For example, FIG. 9 illustrates use of a tapered duct, 11*e*. Here the taper actually off-sets the reduction in axial velocity caused by serial flow losses through the nozzles 16—so the straightening effect is not as pronounced—but a straightening effect is nevertheless achieved by ensuring that the taper angle is sufficiently shallow that there is still a net reduction in axial velocity along the duct: in other words, serial flow losses through the nozzles 16 remain the dominant factor in determining the axial velocity V2.

Figure 10:
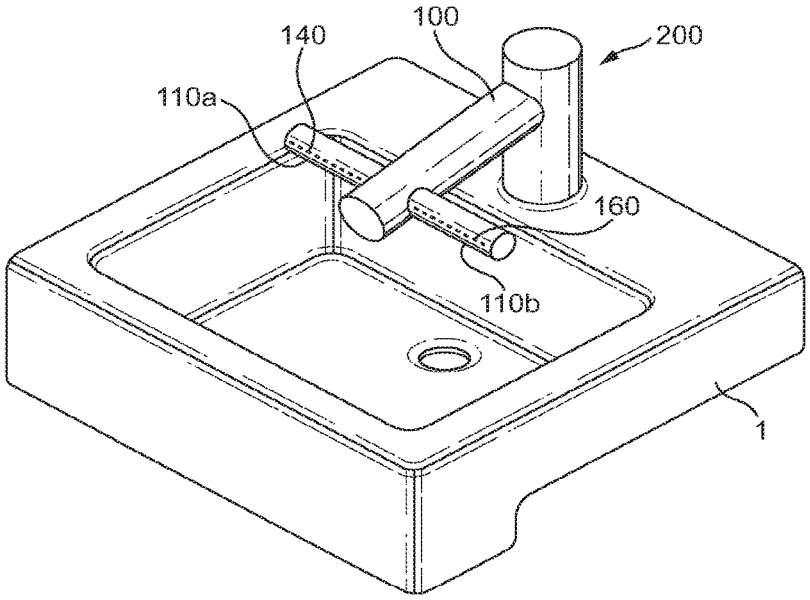
FIG. 10 is a perspective view of an alternative arrangement comprising a fixture fitted to a sink.

The use of opposing pairs of nozzles is not essential. FIG. 10 shows a "single-sided" arrangement in which the fixture 200 has a row of left-hand nozzles 140 on the left-hand side of the spout 100 and a row of right-hand nozzles 160 on the right-hand side of the spout 100. The nozzles 140, 160—which in this case are single rows of circular nozzles—are arranged along respective laterally-extending branch ducts 110*a* and 110*b*: one provided for each set of nozzles 140, 160.

The spout 100 projects forward of the two branch ducts 110*a* and 110*b*, so as to act as a central dividing partition between the left-hand nozzles 140 and the right-hand nozzles 160. The lateral branch ducts are again arranged in the same plane as the spout 100, which is likewise angled downwardly towards the user at an angle of 10 degrees to provide user comfort during use.

Figure 2:
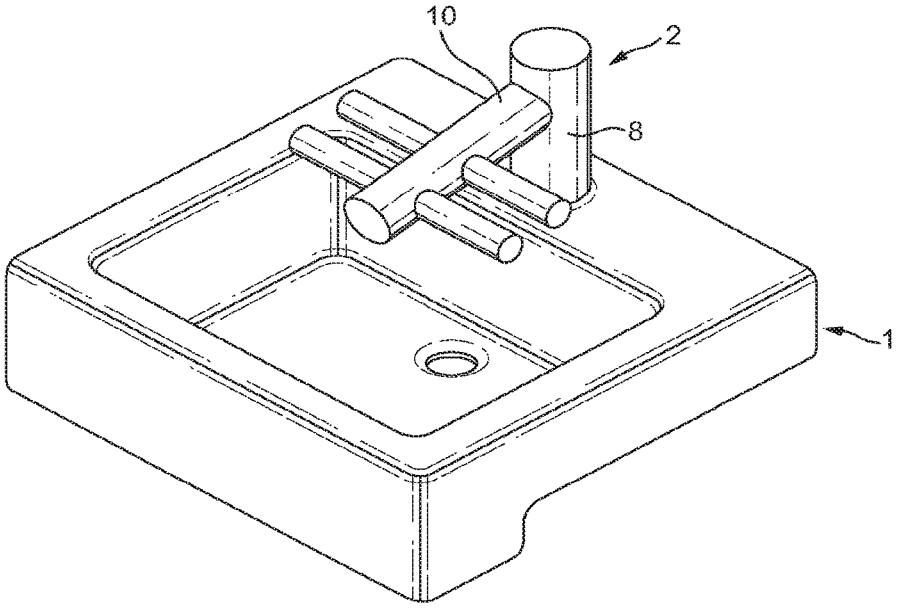
FIG. 2 shows a perspective view of an arrangement comprising a fixture fitted to a sink.
Figure 3:
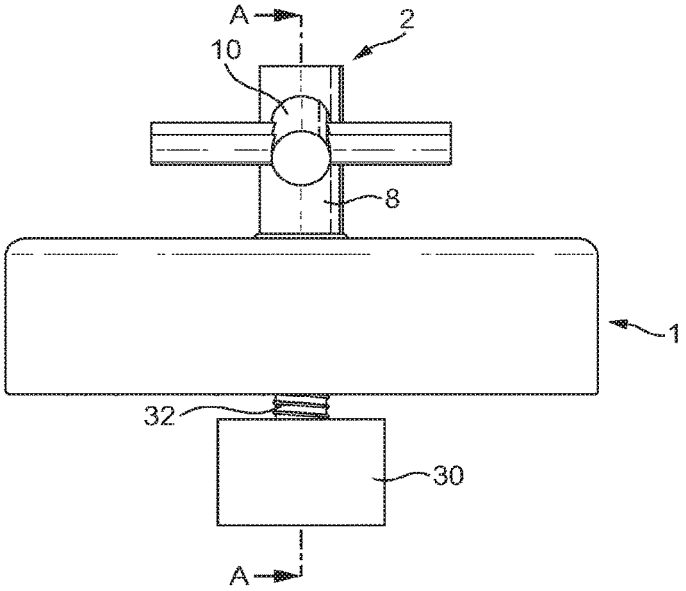
FIG. 3 is a front view of the arrangement in FIG. 2.

The fundamental hand drying action is similar to the "double-sided" arrangement of FIG. 2: the user dips his left hand—palm open—in front of the left-hand nozzles 140 and at the same time dips his right hand—palm open—in front of the right-hand nozzles 160. However, because the nozzles 140, 160 only direct air onto one side of the user's hands, the user must then flip over his hands and repeat the same process for the reverse side of the hands.

Figure 11:
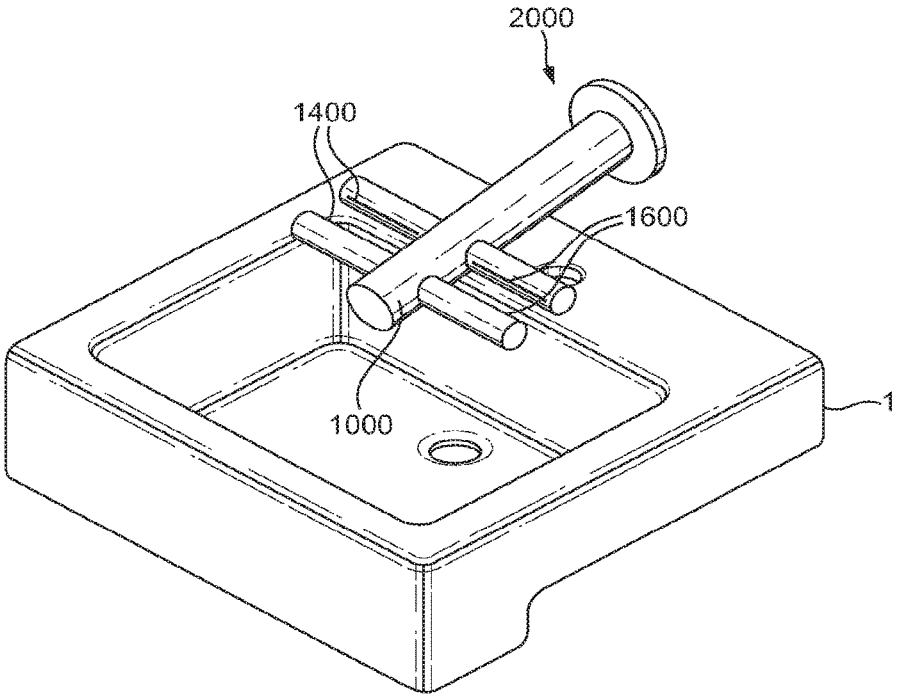
FIG. 11 is a perspective view of an alternative arrangement comprising a fixture which is wall-mounted above a sink.

FIG. 11 shows a wall-mounted arrangement, in which a fixture 2000 is mounted to the wall behind the sink 1. The fixture 2000 is configured to provide "double-sided" drying, via an opposing pair of left-hand nozzles 1400: in this case a pair of elongate slits which in use span the width of a user's hand, and an opposing pair of right hand nozzles 1600: likewise taking the form of a pair of elongate slits.

The left-hand nozzles 1400 are provided on the left-hand side of the spout 1000, whereas the right-hand nozzles 1600 are provided on the right-hand side of the spout 1000. The spout 1000 thus acts as a central dividing partition between the nozzles 1400, 1600.

The fixture 2000 may be fitted to the wall using conventional wall fixings.

Figure 12:
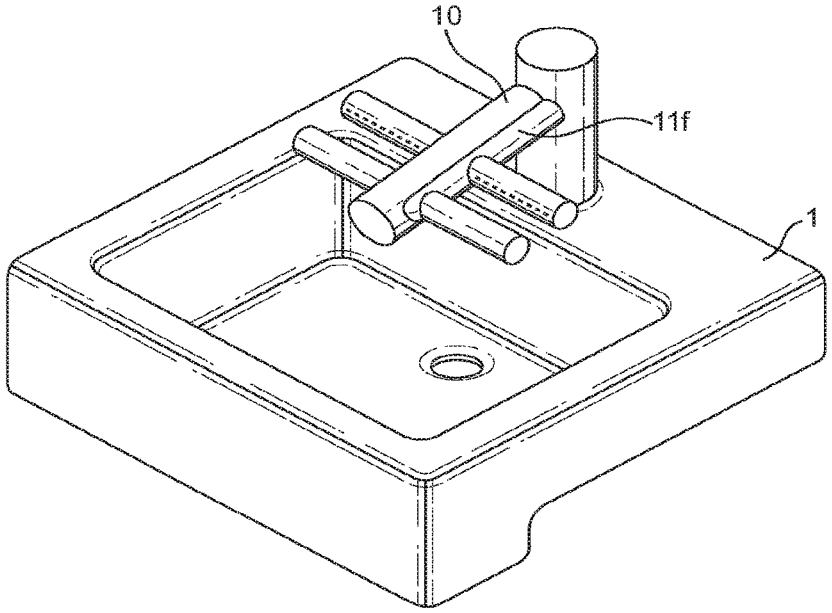
FIG. 12 is a perspective view of an alternative arrangement, illustrating ducting of air along the outside of a spout forming part of the fixture.

The main air supply duct for the nozzles does not have to run through the spout: for example, in the arrangement in FIG. 2, separate air ducts may instead be provided which run in side-by-side relation with the spout 10. This is illustrated in FIG. 12 (only one air duct, 11*f*, is visible). The spout 10 nevertheless acts as a dividing partition between the left-hand and right-hand nozzles.

The invention claimed is:

1. An arrangement comprising a fixture in combination with a sink, the fixture being fitted next to the basin of the sink and comprising a spout which projects over the basin of the sink, this spout comprising a water outlet which is connected to a water supply via a water supply pipe, the arrangement further comprising a hand dryer of the type which uses a high momentum air flow to strip the water from a user's hand, the air flow being discharged through a nozzle on the fixture which is connected to an air supply via an air duct, wherein at least a portion of the water supply pipe is within the air duct.

2. The arrangement of claim 1, in which the nozzle is in a fixed position on the fixture.

3. The arrangement of claim 1, in which the air supply is configured to discharge air through the nozzle at an exit velocity in excess of 100 m/s.

4. The arrangement of claim 1, comprising a sensor for detecting the presence of user's hands and an actuator for automatically dispensing water and/or discharging air in response to detection of a user's hands.

5. The arrangement of claim 2, wherein the nozzle is provided on a respective branch duct which extends laterally from the spout.

6. The arrangement of claim 5, wherein the nozzle on the branch duct spans 80-170 mm.

7. The arrangement of claim 1, in which the nozzle is connected to the air supply via the spout.

8. The arrangement of claim 7, wherein the water outlet is connected to the water supply via the spout.

9. The arrangement of claim 1, wherein the nozzle comprises one or more elongated slits.

10. The arrangement of claim 9, wherein the elongated slits are less than 1 mm wide.

11. The arrangement of claim 9, wherein the fixture comprises two nozzles, arranged on two respective branch ducts, one extending laterally either side of the spout.

12. The arrangement of claim 11, in which the branch ducts are cylindrical.

13. An arrangement comprising a fixture in combination with a sink, the fixture being fitted next to the basin of the sink and comprising a water spout arranged to project over the basin of the sink, the water spout having a water outlet connected through the spout to a water supply via a water supply pipe, the arrangement further comprising a hand dryer for directing air onto the hands of a user, the air being directed through a nozzle, the nozzle being connected to a source of pressurized air via an air duct which in use drives the air through the nozzle at a speed exceeding 100 m/s, wherein at least a portion of the water supply pipe is within the air duct.

14. An arrangement comprising a fixture in combination with a sink, the fixture being fitted next to the basin of the sink and comprising a water spout arranged to project over the basin of the sink, the water spout having a water outlet connected through the spout to a water supply via a water supply pipe, the arrangement further comprising a hand dryer for directing air onto the hands of a user to dry them, the air being directed through a nozzle via an air duct, the nozzle spanning a width of 80-170 mm, wherein at least a portion of the water supply pipe is within the air duct.

15. A fixture for fitting next to the basin of a sink, the fixture comprising a water spout arranged to project over the basin of the sink, the water spout having a water outlet arranged for connection through the spout to a water supply via a water supply pipe, the fixture further comprising a nozzle arranged for connection to a source of pressurized air via an air duct, the nozzle spanning a width of 80-170 mm, wherein at least a portion of the water supply pipe is within the air duct.

* * * * *